US006134816A

United States Patent [19]

Murakami et al.

[11] Patent Number: 6,134,816

[45] Date of Patent: Oct. 24, 2000

[54] HYDRAULIC EXCAVATOR WITH COUPLING PIN ACCESS

[75] Inventors: Yoshiaki Murakami; Hirokazu Imashige, both of Hiroshima, Japan

[73] Assignee: Kabushiki Kaisha Kobe Seiko Sho, Kobe, Japan

[21] Appl. No.: 08/885,134

[22] Filed: Jun. 30, 1997

[30] Foreign Application Priority Data

Jun. 28, 1996 [JP] Japan ..... 8-188095

[51] Int. Cl.[7] ..... E02F 3/32

[52] U.S. Cl. ..... 37/443; 220/562; 37/327; 37/89.13

[58] Field of Search ..... 37/443, 466; 414/694, 414/695, 686, 717, 685; 220/562, 564, 581, 4.14, 86.2; 180/6.58, 6.6, 6.48, 327, 89.13, 89.17, 89.18

[56] References Cited

U.S. PATENT DOCUMENTS

| | | | |
|---|---|---|---|
| 4,056,250 | 11/1977 | Uchiyama | 37/379 X |
| 4,069,637 | 1/1978 | Braithwaite | 37/379 |
| 4,444,542 | 4/1984 | Shaw et al. | 414/694 |
| 4,541,161 | 9/1985 | Shimoie | 37/379 X |
| 5,711,095 | 1/1998 | Oda et al. | 37/379 X |
| 5,715,615 | 2/1998 | Murakami et al. | 37/379 |

FOREIGN PATENT DOCUMENTS

| | | |
|---|---|---|
| 2 340 466 | 9/1977 | France . |
| 56-64818 | 10/1981 | Japan . |
| 61-2557 | 1/1986 | Japan . |
| 4-34126 | 2/1992 | Japan . |
| 4-181009 | 6/1992 | Japan . |
| 6-88352 | 3/1994 | Japan . |

OTHER PUBLICATIONS

Honda Shop Manual, CB700SC NightHawk S, p. 3–5, Oct. 1984.

Sears/Craftsman Electric Chain Saw Operator's Manual, p. 20, Dec. 1991.

Homelite BP250 Blower Owner's Manual, p. 7, Dec. 1996.

Toyota Truck & 4Runner 1988 Repair Manual, p. FA–31, FA–70,TF–4,BR–30,BR–37,EM–13,EM–17, Dec. 1988.

Kubota, "RX–502", pp. 27, 125, 146, and 160, Sep. 1995.

*Primary Examiner*—Victor Batson

*Attorney, Agent, or Firm*—Oblon, Spivak, McClelland, Maier & Neustadt, P.C.

[57] ABSTRACT

A pin is laid out so as to pass through a boom laid out between a pair of bosses of the center frame of the upper rotating body, and are attachably, detachably, and pivotably mounted on the boom. A cab is laid out on one side of the pair of bosses, and oil tanks such as a hydraulic oil tank and fuel oil tank are laid out on the other side thereof. The sections of oil tanks that meet the extension line of the center line of the pins are formed as a space section with which the pin does not interfere when the pin is moved along the extension line. In the upper rotating body where the hydraulic oil tank and the fuel oil tank are laid out to keep the relation of the front and rear positions, the space between both oil tanks is positioned nearly on the extension line of the center line of the pins, and a cut section of the oil tank is formed on at least one side of both oil tanks, and besides partly hollowly.

9 Claims, 7 Drawing Sheets

HYDRAULIC EXCAVATOR WITH COUPLING PIN ACCESS

BACKGROUND OF THE INVENTION

1. Field of the Invention

The present invention relates to a hydraulic excavator such as primarily a hydraulic excavator of which rotating radius is small.

2. Description of the Related Art

FIG. 7 shows the prior art described in Japanese Patent Laid-Open Hei 4-181009. In the hydraulic excavator shown in FIG. 7, reference number 1 represents a boom. Mounting bracket 2 is located in the bottom end section of the boom 1. A joint pin 3 is mounted on the mounting bracket 2. One end of said joint pin 3 is blocked by a cabin 4. However, there is no interference device on the other end of the joint pin 3. Namely, there is no devices interfering with the joint pin 3 when extracting the joint pin in the direction A Accordingly, in order to pull out the joint pin 3, as FIG. 7 shows, an upper rotating body 6 is turned in the direction perpendicular to a lower traveling body 5. Next, a stationary object 7, and an extraction plug 8 mounted on the joint pin 3 are connected with a wire 9. After that, the lower traveling body 5 is moved in the direction of arrowhead C to remove the joint pin 3, thereby enabling the joint pin 3 to be pulled out from the mounting bracket 2 in the direction of arrowhead A.

FIG. 8 shows the prior art described in Japanese Utility Model Laid-Open Sho 61-2557. In the boom mounting apparatus shown in FIG. 8, on one side of the boom mounting section of a swing frame 10 a boss 11 is used. On the contrary, the other side thereof is provided with a U-shape pin bearing 12. The U-shape pin bearing 12 has four bolting female screws 13. A pin crossarm brace 14 is to be attached by four bolts 17 with spring washers 15 and flat washers 16. Accordingly, when attaching and detaching the boom, it is not necessary to pull out the joint pins in the horizontal direction, and the boom can be attached or detached without removing obstructions such as the cabin, fuel oil tank, etc.

Recently, a lot of kinds of hydraulic excavators of which rotating radius is small, designed to be suitable for work in urban areas, are produced. This type of hydraulic excavator is provided with a cab installed on one side of the boom mounting section of the upper rotating body, and with oil tanks such as hydraulic oil tank and fuel oil tank on the other side thereof.

Accordingly, it is difficult to attach and detach the joint pin for connecting the boom. Further, in the boom mounting apparatus of the prior art shown in FIG. 8, the bearing for pivotably supporting the pin installed in the rotating frame 10 is formed into a split type bearing consisting of the U-shape pin bearing 12 and the pin crossarm brace 14 to damp the pin with the bolts. In the case of the prior art shown in FIG. 8, when the hydraulic excavator is executing an excavation work, a large impact is repeatedly applied to the bolt 17, thereby shortening the period of durability of the bolt 17. In addition, problems on maintenance may arise.

SUMMARY OF THE INVENTION

An object of the invention is to provide a hydraulic excavator having the maximum space for loaded devices thereon.

Another object of the invention is to provide a hydraulic excavator designed not to degrade the strength, durability, etc. of the pins for connecting the boom and the pin mounting sections.

The hydraulic excavator of the present invention consists of a lower traveling body, and an upper rotating body rotatably mounted on the lower traveling body. The upper rotating body is loaded with an oil tank on one side thereof. The upper rotating body is further loaded with a center frame having bosses. Pins are horizontally inserted in the bosses. The pins are pivotably connected to the upper rotating body. A spatial section is prepared on the extension line of the center line of the pins so that the pins do not interfere with the oil tank when the pins are horizontally pulled out.

This spatial section may be formed by partly cutting off either the hydraulic oil tank or fuel oil tank. Additionally, which oil tank, either the hydraulic oil tank or the fuel oil tank, should be partly cut off to form the spatial section may be selected by considering which selection is better for the function of the hydraulic excavator. Further, this spatial section may be formed by positioning an interface section, where both oil tanks face each other, nearly on the extension line of the center line of the pins. This spatial section may furthermore be formed by using the space between the hydraulic oil tank and the fuel oil tank. These cases enable one to easily pull out pins while securely inspecting the operation of pulling out pins from the above.

The spatial section may also be formed in the hydraulic oil tank by locating the fuel oil tank so that the longitudinal direction of the fuel tank is perpendicular to the longitudinal direction of the boom, and by locating the hydraulic oil tank so that it comes behind the fuel oil tank with the longitudinal direction of the hydraulic oil tank in parallel with the longitudinal direction of the boom. In this case, the control valves may be located outward the hydraulic oil tank and backward the extension line.

Furthermore, the spatial section for enabling the pin to be pulled out horizontally may be formed by parting the hydraulic oil tanks from the boss by nearly the same distance as that between the oil tank and the pin.

In this case, the space between the hydraulic oil tank and said boss may be used as said space that enables the pin to be pulled out horizontally by locating the fuel oil tank so that the longitudinal direction thereof is perpendicular to the longitudinal direction of the boom, and by locating the hydraulic oil tank so that it comes behind the fuel oil tank with the longitudinal direction of the hydraulic oil tank in parallel with the longitudinal direction of the boom. Further, in this case, the control valve may be located so that it comes inside the hydraulic oil tank and behind the extension line. With this layout, pulling out the pin can be easily carried out without trouble, and also the necessity of partly cutting off the oil tank can be eliminated.

DESCRIPTION OF THE PREFERRED EMBODIMENTS

The following explains embodiments of the invention in detail on the basis of the attached drawings.

Figure 1:
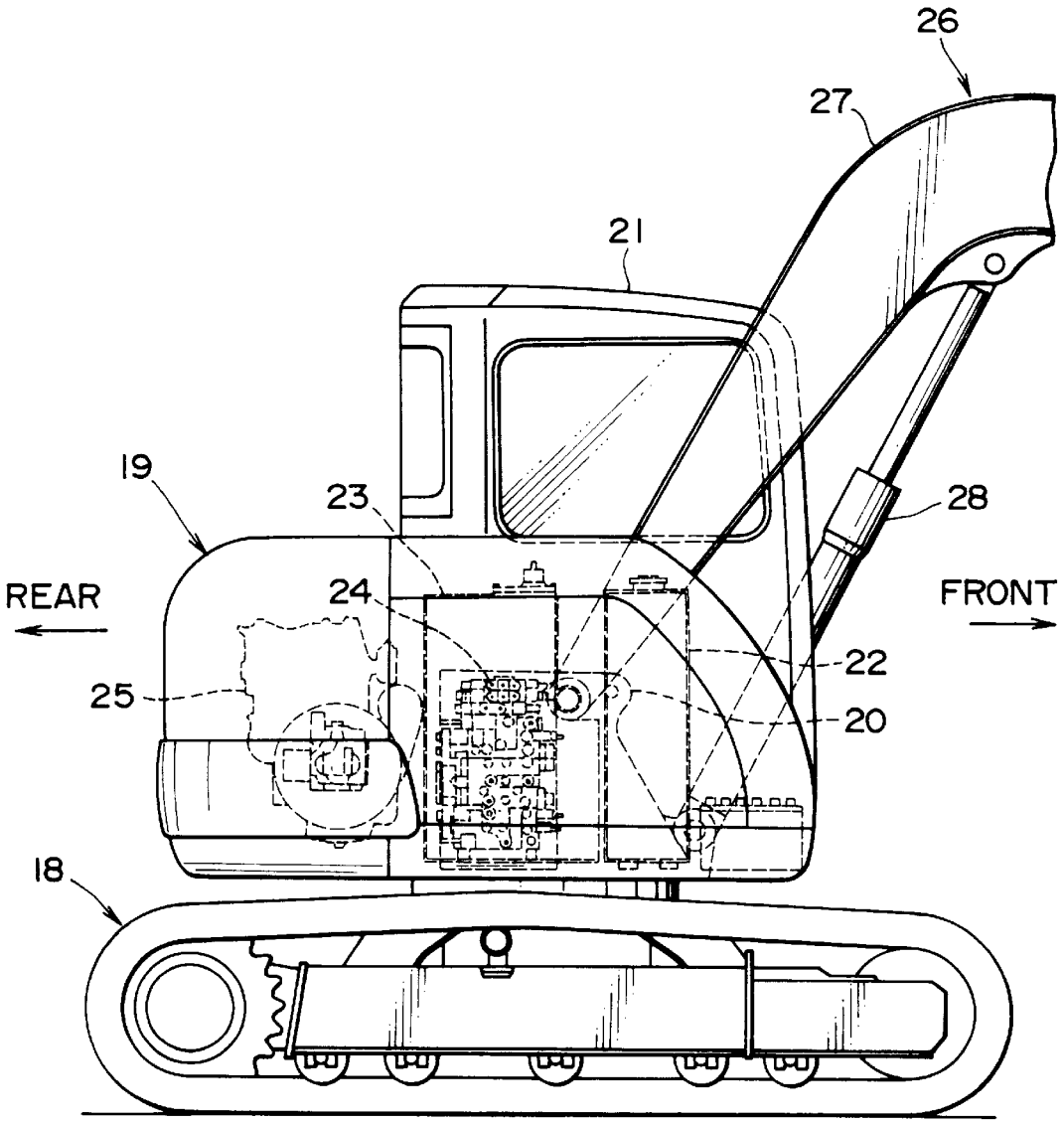
FIG. 1 is a side view of the hydraulic excavator of the first embodiment of the invention.

First, the mechanical configuration of the first embodiment of the invention is explained using FIGS. 1 through 4. FIG. 1 is a side view of the hydraulic excavator of the first embodiment of the invention. In FIG. 1, reference number 18 represents the lower traveling body of the hydraulic excavator. Reference number 19 is the upper rotating body rotatably mounted on the top of the traveling body 18. Reference number 20 represents the center frame of the upper rotating body 19. Reference number 21 represents a cab laid out on the left side of the front section of the upper rotating body 19. Reference number 22 represents a fuel oil tank laid out on the right side of the front section of the upper rotating body 19. Reference number 23 is a hydraulic oil tank laid out behind the fuel oil tank 22. Reference number 24 represents control valves for controlling a hydraulic actuator located on the right side of the hydraulic oil tank 23. Reference number 25 represents an engine loaded on the rear section of the upper rotating body 19. Reference number 26 represents a working attachment attached to the front section of the upper rotating body 19. Reference number 27 represents a boom for the working attachment 26. Reference number 28 represents a boom cylinder which drives the boom 27. Additionally, the layout of each component will be more easily understood by referring to FIG. 3.

Figure 2:
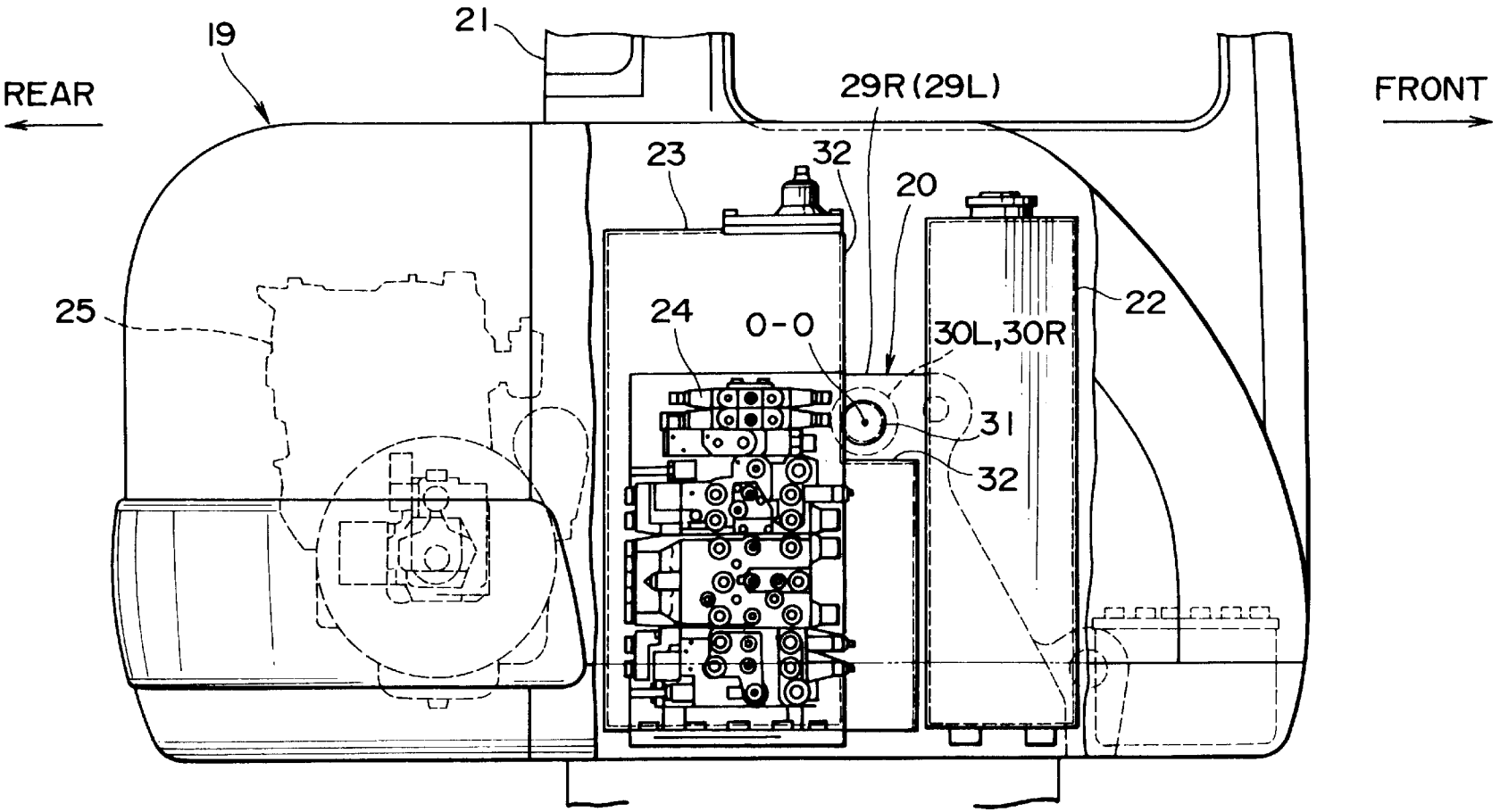
FIG. 2 is a partly cut opened perspective view of the vital section of the upper rotating body shown in FIG. 1.

FIG. 2 is a partly cut opened side view of the main section of the upper rotating body 19. In FIG. 2, reference numbers 29L and 29R are a pair of non-pivoting left and right vertical plates. Additionally, the vertical plates 29L and 29R are components of the center frame 20. Reference numbers 30L and 30R represent the bosses attached to the vertical plate 29L and 29R, respectively. Reference number 31 represents a pin to be attachably and detachably inserted in the aforementioned bosses 30L and 30R. The pin 31 attachably, detachably, and pivotably supports bottom end bosses (not numbered in the figure) of the boom 27. Reference number 32 represents a cutoff section formed in the hydraulic oil tank 23.

Figure 3:
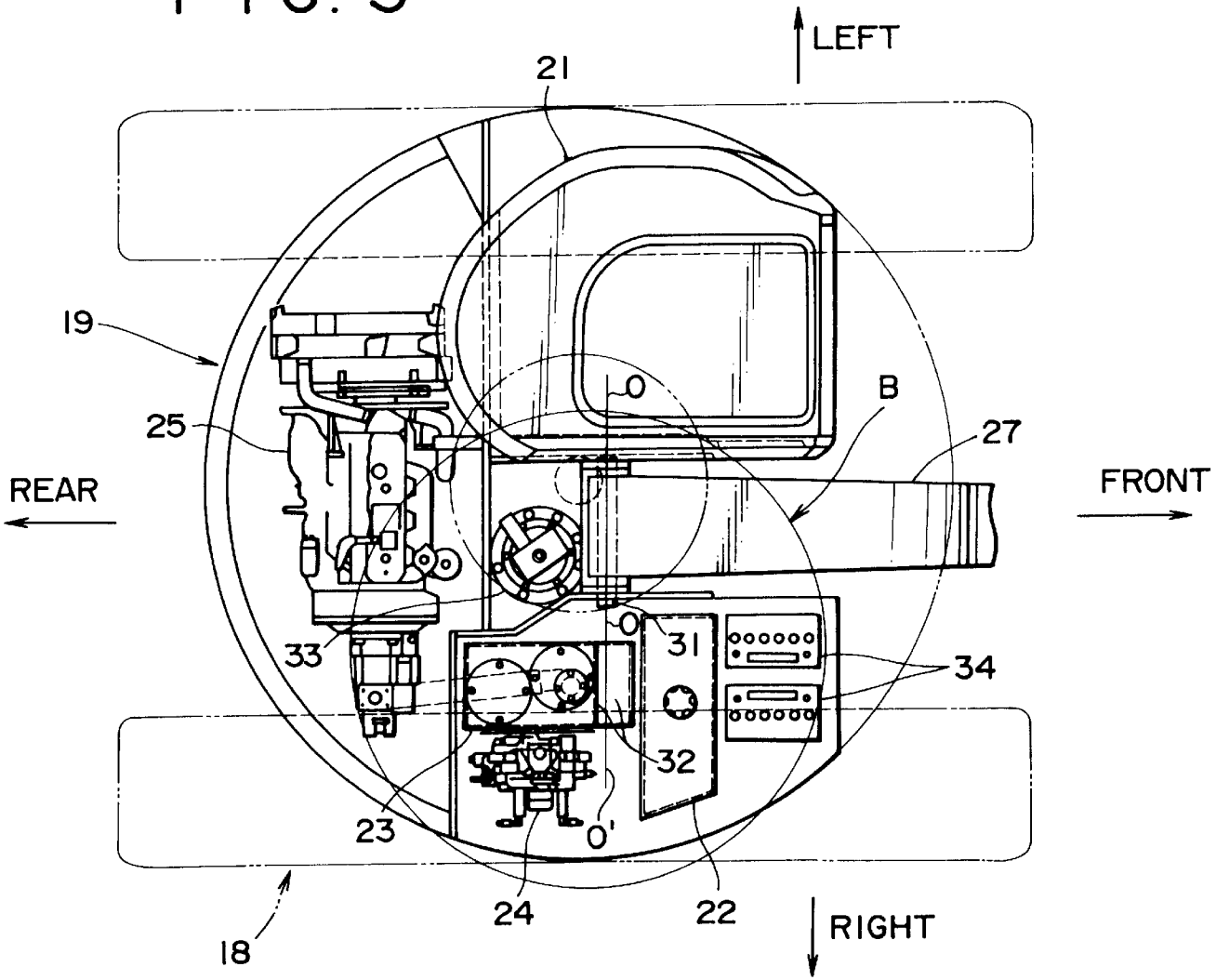
FIG. 3 is a cut open perspective plan view of the upper rotating body shown in FIG. 1.
Figure 4:
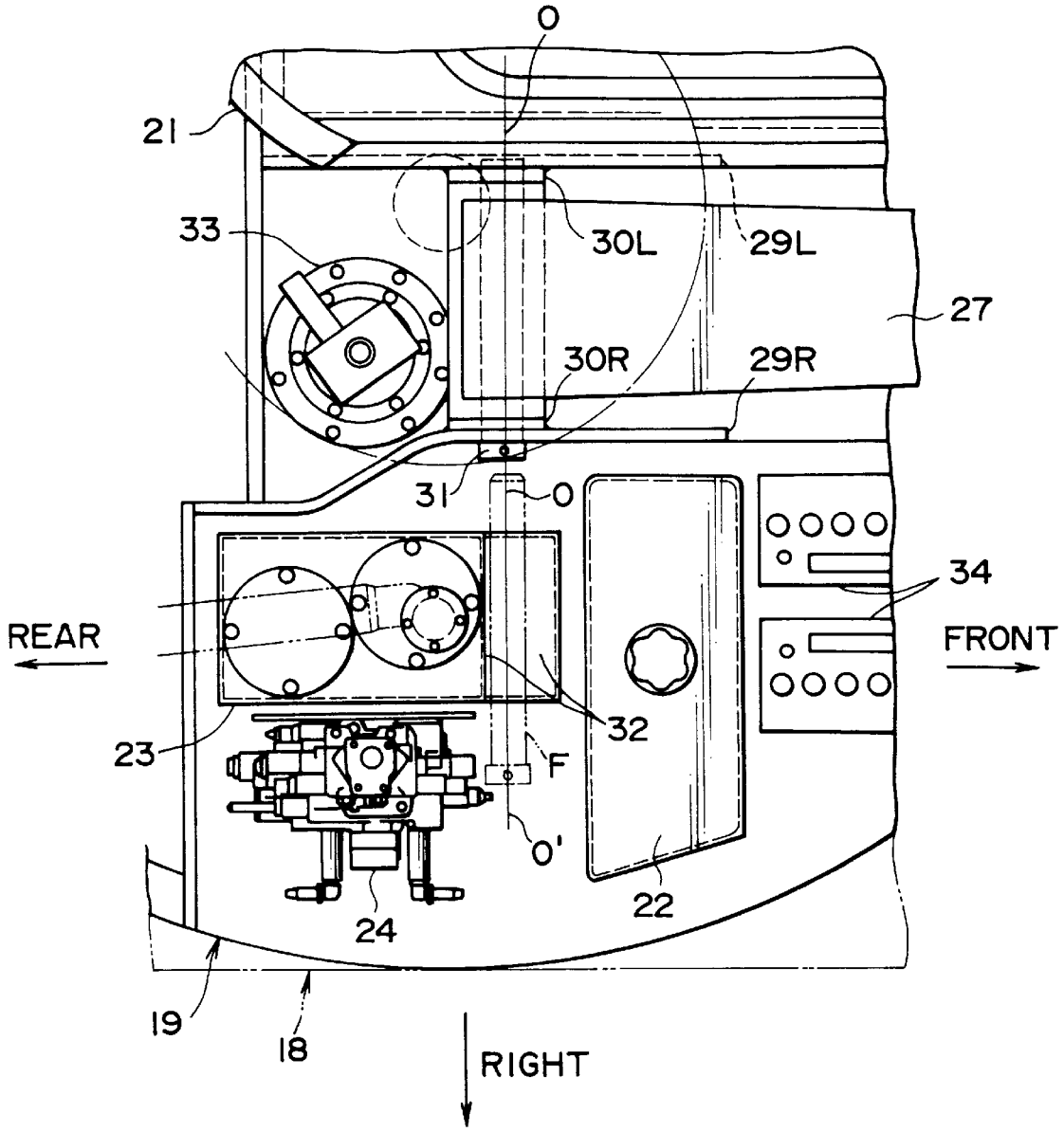
FIG. 4 is an enlarged view of section B of FIG. 3.

FIG. 3 is a cut opened plan view of the upper rotating body 19 shown in FIG. 1. In FIG. 3, reference number 33 represents a rotating motor which rotates the upper rotating body 19. Reference number 34 represents a battery. FIG. 4 is an enlarged drawing of the section B shown in FIG. 3.

Next, the operation of the first embodiment of the invention will be explained by FIGS. 1 through 4. In the first embodiment, as shown in FIGS. 3 and 4, the space between the hydraulic oil tank 23 and the fuel oil tank 22 installed in the upper rotating body 19 is positioned on the extension line O–O' of the center line O—O of the pin 31 for coupling the bottom end section of the boom 27 with the upper rotating body 19. In FIG. 4, the section which is encircled by the double-dashed line F is the pin 31. The pin 31 can be moved on the extension line O–O', and does not interfere with both the hydraulic oil tank 23 and the fuel oil tank 22. Reference number 32 represents the partly cut off section prepared in the hydraulic oil tank 23. The cutoff section 32 is formed by partly hollowing out the upper section of the hydraulic oil tank 23. Accordingly, the aforementioned cutoff section 32 may be formed in either hydraulic oil tank 23 or fuel oil tank 22 considering which oil tank should be partly formed to have a cutoff section is better for the function of the hydraulic excavator. In the case of the first embodiment, pulling out the pin 31 can be easily and securely done while inspecting the pulling out operation from above. Repeating the description once more, the aforementioned cutoff section may be formed in either one of hydraulic oil tank 23 and fuel oil tank 22, or may further be formed respectively on both sides of the interface section where both oil tanks face each other. Furthermore, instead of forming the hollowed section in either one of both oil tanks, it may also be permitted to widen the space between both oil tanks 23 and 22 so that the pin 31 can be passed through this space when pulling out the pin 31.

Figure 5:
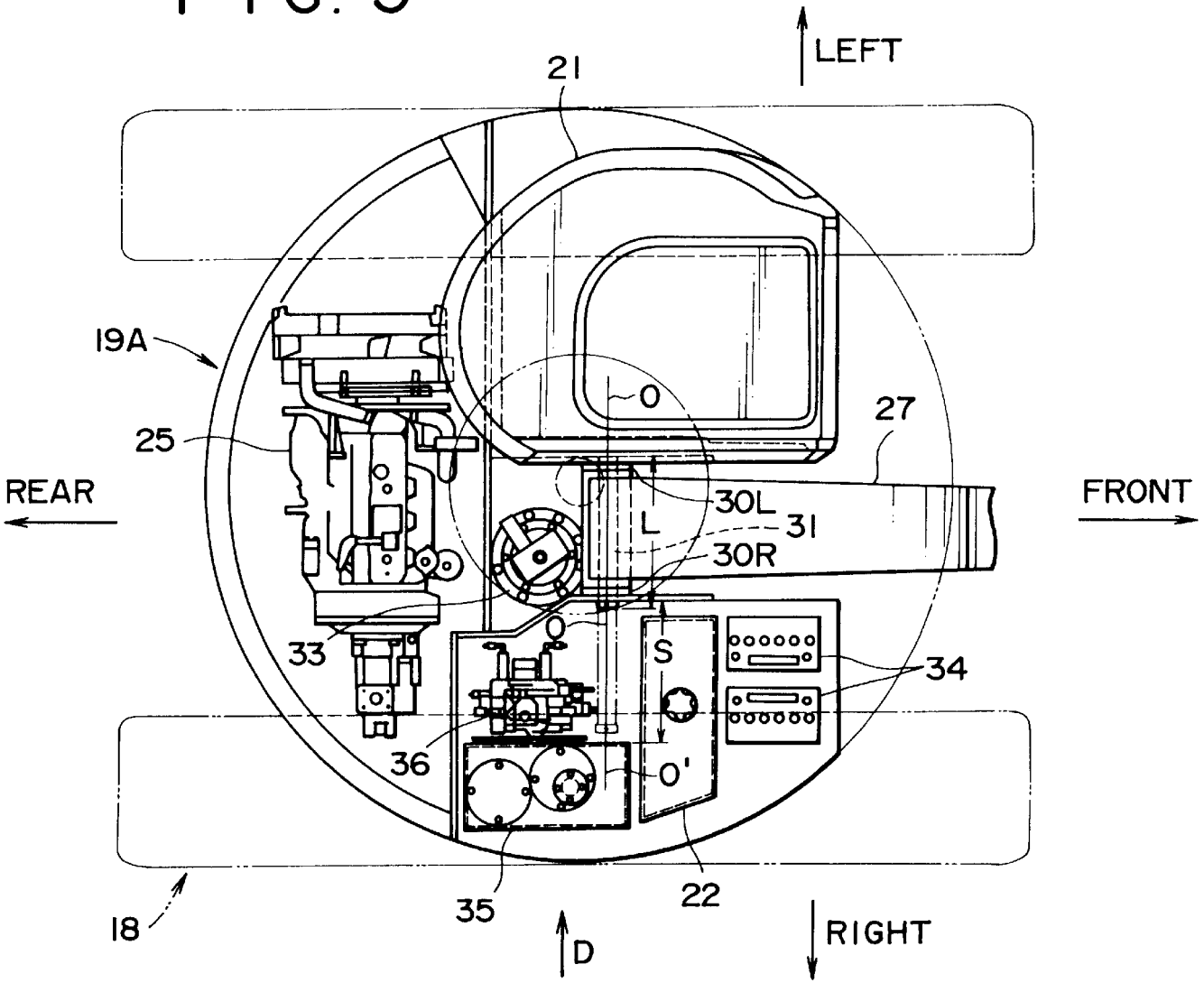
FIG. 5 is a partly cut open perspective view of the vital section of the upper rotating body of the hydraulic excavator shown in the second embodiment of the invention.
Figure 6:
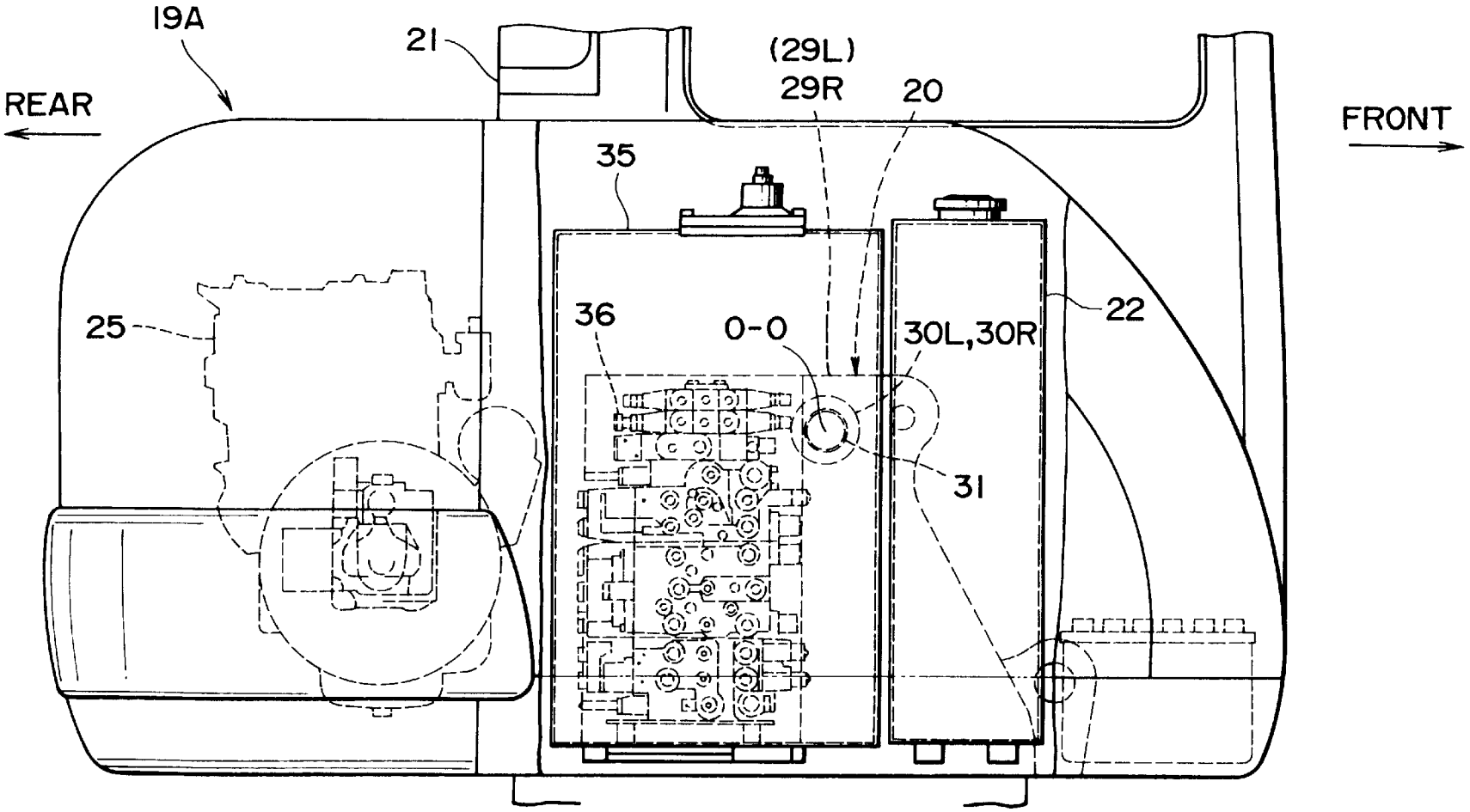
FIG. 6 is a partly cut opened perspective view of the vital section of the upper rotating body as viewed from point D of FIG. 5.
Figure 7:
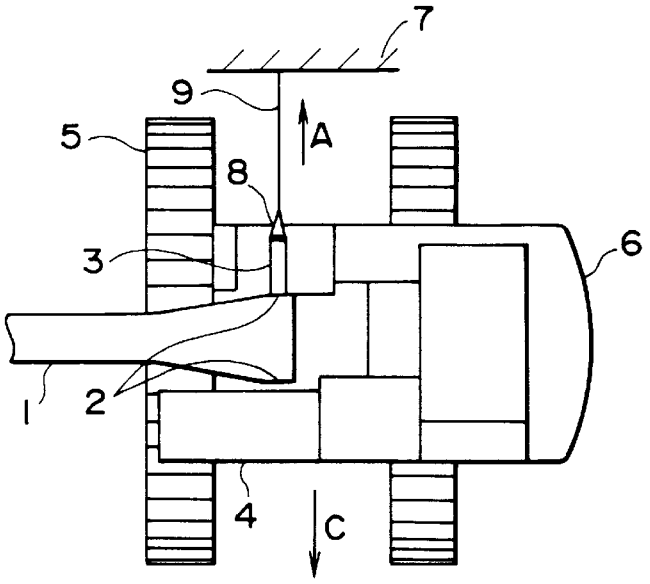
FIG. 7 PRIOR ART
FIG. 7 is a general view of the hydraulic excavator showing a conventional method of prior art for connecting the pin.
Figure 8:
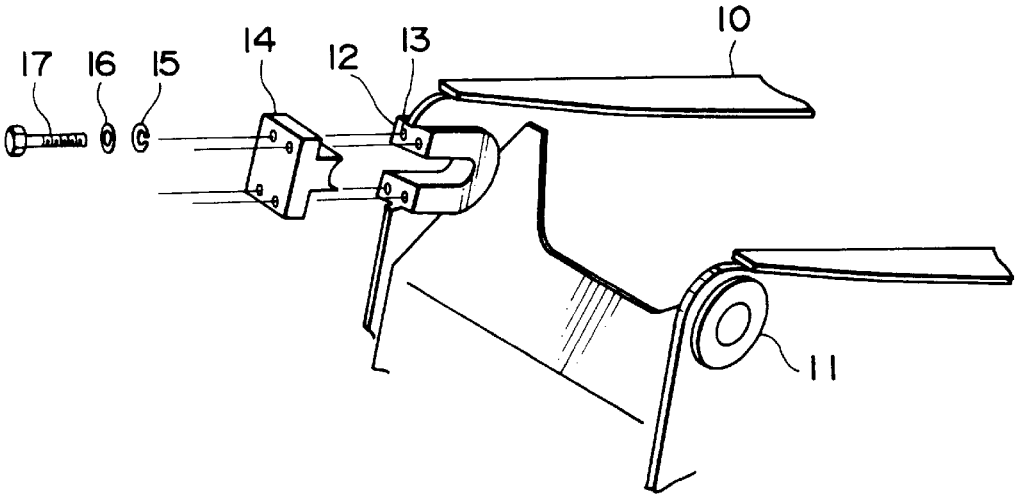
FIG. 8 PRIOR ART
FIG. 8 is a perspective view showing a conventional boom mounting apparatus.

Next, the second embodiment of the invention will be explained by FIGS. 5 and 6. FIG. 5 is a cut open plan view showing an upper rotating body 19A of the small hydraulic excavator of the second embodiment of the invention. FIG. 6 is a partly cut open side view as viewed from arrowhead D of FIG. 5. In FIGS. 5 and 6, those which are also used in FIGS. 3 and 4 are numbered the same reference numeric characters. In FIGS. 5 and 6, reference number 35 represents a hydraulic oil tank. Reference number 36 represents control valves installed inside the hydraulic oil tank.

Next, the operation of the second embodiment of the invention will be described by FIGS. 5 and 6. In this second embodiment, between the boss 30R of the center frame 20 and the hydraulic oil tank 35, there is a space S whose length is about the same as the whole length of the pin 31 to which the bottom end section of the boom 27 is pivotably connected. In this space S, is laid out control valves 36 for controlling hydraulic actuators. The control valves 36 is laid out far behind the extension line so as not interfere with the extension line O–O' of the center line O—O of aforementioned pin 31. Accordingly, the aforementioned pin 31 can be easily pulled out through the aforementioned space S without trouble. Moreover, in the second embodiment, as was explained in said first embodiment, it can be eliminated to partly cut off the oil tanks.

We claim:

1. A hydraulic excavator comprising:

a lower traveling body;

an upper body rotatably mounted on said lower traveling body;

a boom frame mounted to said upper body and having bosses aligned on a substantially horizontal pin center line;

a cab mounted to said upper body at one side of said boom frame;

an oil tank mounted to said upper body at another side of said boom frame and substantially in alignment with said pin center line; and a pin fittable in said bosses to connect a boom to said boom frame, said pin being removable from said bosses by movement of said pin along said pin center line, wherein said oil tank is configured such that said pin does not interfere with said oil tank when removing said pin from said bosses, wherein said oil tank is a first oil tank, further comprising a second oil tank adjacent said first oil tank, wherein a space between said first and second oil tanks is aligned with said pin center line.

2. The hydraulic excavator of claim 1, further comprising a control valve positioned on a same side of said pin center line as said first oil tank, wherein said first oil tank is positioned between said boom frame and said control valve.

3. The hydraulic excavator of claim 1, wherein said oil tank is a first oil tank, further comprising a second oil tank adjacent said first oil tank, wherein a longer dimension of said first oil tank is substantially perpendicular to said pin center line, and a longer dimension of said second oil tank is substantially parallel to said pin center line.

4. The hydraulic excavator of claim 3, further comprising a control valve positioned on a same side of said pin center line as said first oil tank, wherein said control valve is positioned between said boom frame and said first oil tank.

5. A hydraulic excavator comprising:

a lower traveling body;

an upper body rotatably mounted on said lower traveling body;

a boom frame mounted to said upper body and having bosses aligned on a substantially horizontal pin center line;

a cab mounted to said upper body at one side of said boom frame;

an oil tank mounted to said upper body at another side of said boom frame and substantially in alignment with said pin center line; and a pin fittable in said bosses to connect a boom to said boom frame, said pin being removable from said bosses by movement of said pin along said pin center line, wherein said oil tank is configured such that said pin does not interfere with said oil tank when removing said pin from said bosses, wherein a distance between said oil tank and said bosses is nearly the same as a length of said pin.

6. The hydraulic excavator of claim 5, wherein a longer dimension of said first oil tank is substantially perpendicular to said pin center line, and a longer dimension of said second oil tank is substantially parallel to said pin center line.

7. A hydraulic excavator comprising:

a lower traveling body;

upper body rotatable mounted on said lower traveling body;

a boom frame mounted to said upper body and having bosses aligned on a substantially horizontal pin center line;

a cab mounted to said upper body at one side of said boom frame;

an oil tank mounted to said upper body at another side of said boom frame and substantially in alignment with said pin center line; and a pin fittable in said bosses to connect a boom to said boom frame, said pin being removable from said bosses by movement of said pin along said pin center line, wherein said oil tank is configured such that said pin does not interfere with said oil tank when removing said pin from said bosses, wherein said oil tank has a cutoff portion aligned with said pin center line.

8. The hydraulic excavator of claim 7, wherein said oil tank is a first oil tank, further comprising a second oil tank adjacent said first oil tank.

9. A hydraulic excavator comprising:

a lower traveling body;

an upper body rotatably mounted on said lower traveling body;

a boom frame mounted to said upper body and having non-pivoting bosses, aligned on a substantially horizontal pin center line;

a cab mounted to said upper body at one side of said boom frame;

an oil tank mounted to said upper body at another side of said boom frame and substantially in alignment with said pin center line; and a pin fittable in said bosses to connect a boom to said boom frame, said pin being removable from said bosses by movement of said pin along said pin center line, wherein said oil tank is configured such that said pin does not interfere with said oil tank when removing said pin from said bosses.

* * * * *